US007965238B2

(12) United States Patent
Rikuta et al.

(10) Patent No.: US 7,965,238 B2
(45) Date of Patent: Jun. 21, 2011

(54) WIDE BAND ANTENNA COMMON TO A PLURALITY OF FREQUENCIES

(75) Inventors: Yuko Rikuta, Koganei (JP); Ryuji Kohno, Koganei (JP)

(73) Assignee: National Institute of Information and Communications Technology, Incorporated Administrative Agency, Tokyo (JP)

( * ) Notice: Subject to any disclaimer, the term of this patent is extended or adjusted under 35 U.S.C. 154(b) by 520 days.

(21) Appl. No.: 10/570,999

(22) PCT Filed: Sep. 9, 2004

(86) PCT No.: PCT/JP2004/013161

§ 371 (c)(1),
(2), (4) Date: Aug. 7, 2008

(87) PCT Pub. No.: WO2005/027267

PCT Pub. Date: Mar. 24, 2005

(65) Prior Publication Data

US 2008/0284653 A1 Nov. 20, 2008

(30) Foreign Application Priority Data

Sep. 9, 2003 (JP) ..... 2003-317339

(51) Int. Cl.
*H01Q 1/38* (2006.01)

(52) U.S. Cl. ..... 343/700 MS; 343/797; 343/753; 343/893

(58) Field of Classification Search ..... None
See application file for complete search history.

(56) References Cited

U.S. PATENT DOCUMENTS

| | | | | |
|---|---|---|---|---|
| 6,437,750 | B1 * | 8/2002 | Grimes et al. | 343/726 |
| 6,700,542 | B2 * | 3/2004 | Borlez et al. | 343/700 MS |
| 6,992,635 | B2 * | 1/2006 | Nishiyama et al. | 343/700 MS |
| 7,129,892 | B2 * | 10/2006 | Borlez et al. | 343/700 MS |
| 7,133,810 | B2 * | 11/2006 | Butler et al. | 703/2 |
| 2003/0076264 | A1 | 4/2003 | Yuanzhu | |

FOREIGN PATENT DOCUMENTS

JP 43-029185 B1 12/1968

(Continued)

OTHER PUBLICATIONS

2004 Synthesis Conference of Electric Information Communication Institution; Orthogonal Planar Monopole Antenna with Dual Frequency for UWB System; Yuko Rikuta et al: Communication Research Laboratory. Submitted with verified English translation, 5 pages, 2004.

(Continued)

*Primary Examiner* — Trinh V Dinh
(74) *Attorney, Agent, or Firm* — Birch, Stewart, Kolasch & Birch, LLP

(57) ABSTRACT

An antenna common to a plurality of frequencies in which a wide band of a UWB system can be covered while suppressing interference with other systems. The antenna comprises a plurality of element part conductors, coupling conductors for coupling them electrically, and a feeder for coupling one element part conductor electrically with a feeder part capable of feeding to that element part conductor, wherein respective element part conductors are concatenated sequentially by the coupling conductors. The element part conductor has a shape substantially symmetric to a line connecting the coupling conductors or the parts coupled with the feeder. Each coupling conductor is arranged substantially linearly and the plane part of each planar conductor is arranged substantially vertically.

7 Claims, 13 Drawing Sheets

FOREIGN PATENT DOCUMENTS

| | | | |
|---|---|---|---|
| JP | 9-223921 | A | 8/1997 |
| JP | 10-275033 | A | 10/1998 |
| JP | 10-276033 | A | 10/1998 |
| JP | 2000-508498 | A | 7/2000 |
| JP | 2002-124812 | A | 4/2002 |
| JP | 2003-142931 | A | 5/2003 |
| JP | 2003-273638 | A | 9/2003 |

OTHER PUBLICATIONS

2004 International Workshop on Ultra Wideband Systems Joint with Conference on Ultra Wideband Systems and Technologies; May 18-21, 2004; Hotel Granvia Kyoto, Kyoto, Japan; Conference Proceedings Characteristics of Planar and Orthogonal Planar Monopole Antenna with Dual Frequency for UWB System; Yuko Rikuta et al., pp. 171-175.

* cited by examiner

WIDE BAND ANTENNA COMMON TO A PLURALITY OF FREQUENCIES

RELATED APPLICATIONS

This application is the U.S. National Phase under 35 U.S.C. §371 of International Application No. PCT/JP04/13161, filed on Sep. 9, 2004, which in turn claims the benefit of Japanese Application No. 2003-317339, filed on Sep. 9, 2003, the disclosures of which Applications are incorporated by reference herein.

TECHNICAL FIELD

The present invention relates to an antenna common to a plurality of frequencies, which shows a wide band characteristic, more particularly, a wide band antenna common to a plurality of frequencies, which shows a characteristic having a notch in a part of frequency band.

BACKGROUND ART

As basic antennas, a dipole antenna, a monopole antenna, an inverted L antenna, and a slit antenna are known.

The dipole antenna is an antenna composed of two connected bars of conductor with quarter wavelength and is used as an antenna for FM broadcast or terrestrial television.

The monopole antenna is considered as a detached half of the dipole antenna and is used as an antenna for AM broadcast, transceivers, or mobile telephones.

The inverted L antenna is a modification of the monopole antenna and considered as an antenna having an antenna element bent at the base and widened. Since its shape may be small with respect to wavelength of radio wave and the antenna may be adapted to wide band, it is used as an antenna for cordless telephones or mobile telephones.

In the slit antenna, an elongated hole located on conductor constitutes the antenna and the length of the hole has an effect on the antenna characteristics.

As wide band antennas used in a UWB (ultrawideband) system, an antenna with a space structure typified by a double ridge guide horn antenna, a circular plate monopole antenna, or a planar dipole antenna in various shapes are disclosed in Non-patent Document 1.

On the other hand, since the UWB is a system covering wide frequency band in range of 3.1 to 10.6 [GHz], it is required to suppress interference with other systems with band in 5 [GHz] or the like.

Non-patent Document 1: N. P. Agrawall, et. al., IEEE Trans. Ant. Prop., Vol. 46, No. 2, 1998

In order to provide an antenna common to a plurality of frequencies, a plurality of antennas having each resonance frequency may be arranged, for example. However, this may bring a disadvantage that the antenna structure becomes relatively complicated. Accordingly, such disadvantage will be overcome when one antenna is common to a plurality of frequencies, but band covered by each resonance frequency is not generally a wide band.

In other words, there had been no antenna common to a plurality of frequencies, with simple structure, for covering a wide band assigned in the UWB system and suppressing interference with other systems.

For example, a monopole antenna with a simple structure having a slit is disclosed in Patent Documents 1 and 2; however, wide band characteristics and frequency sharing are not provided by those related arts.

Patent Document 1: Japanese Patent Application Laid-Open No. 2002-290139

Patent Document 2: Japanese Patent Application Laid-Open No. 2003-37431

Further, in Patent Document 3, a wide band antenna device assuming the UWB system is disclosed. In this disclosure, a structure in which a plurality of element antenna patterns having different resonance frequencies is described; however, an antenna which is originally assigned for a narrow band is adapted to a wide band with use of multiple resonance.

That is, the antenna is adapted to a wide band by overlapping two or more narrow band resonances so that such antenna does not include a function for suppressing interference with other systems or filtering. Further, since feeding structure is required for each element antenna pattern, there has been a problem that the structure becomes complicated.

Patent Document 3: Japanese Patent Application Laid-Open No. 2003-101342

DISCLOSURE OF THE INVENTION

Problem to be Solved by the Invention

An object of the present invention is to provide an antenna common to a plurality of frequencies for covering a wide band assigned to the UWB system and the like and suppressing interference with other systems.

Means for Solving the Problem

In order to solve the problem, the present invention provides a wide band antenna common to a plurality of frequencies including a planar monopole antenna structure which has wide band characteristic to cover preferable frequencies and suppress interfering frequency band, including: a plurality of element part conductors; a coupling conductor configured to electrically couple the element part conductors; and a feeder configured to electrically couple one of the element part conductors with a feeder part capable of feeding the element part conductor. The respective element part conductors are concatenated sequentially by the coupling conductor on a hypothetical plane.

According to the wide band antenna common to a plurality of frequencies, the element part conductor may have a symmetrical shape with respect to a line connecting coupling parts coupled with the coupling conductor or the feeder, and the respective coupling conductors may be arranged substantially linearly.

With this, an antenna characteristic which is substantially nondirectional is obtained on a plane perpendicular to the straight line.

The element part conductors may be formed in a planar or linear shape, the planar or linear conductors may be provided parallel, and the linear conductor may be provided substantially perpendicular to the coupling conductor. Various changes made in structure of the element part conductor contribute to providing antennas having various frequency characteristics.

The present invention may provide a wide band antenna common to a plurality of frequencies in which the planar conductors are formed in squared shape and the plane parts of each planar conductor are provided almost substantially vertically.

With this, its structure becomes easy and simple and an antenna characteristic which is horizontally almost nondirectional can be obtained.

According to the wide band planar monopole antenna common to a plurality of frequencies, an interval of each element planar conductor may be adjustable. With this, its antenna characteristic can be changed easily.

The hypothetical plane may be composed of at least one substantive substrate and at least one of the element part conductor or the coupling conductor may be formed of a conductor pattern on the substrate. Such structure provides an antenna that is easy in manufacturing, superior in decay resistance and stability, and contributes to downsizing.

The plurality of element part conductors may be combined with respect to the coupling parts as a central axis. Particularly, two wide band antennas common to a plurality of frequencies may be combined with respect to the coupling parts as a central axis such that the hypothetical planes are arranged orthogonal, and an orthogonal planar monopole antenna structure may be composed.

With this, improved nondirectional characteristic can be obtained.

According to the present invention, in the wide band planar monopole antenna common to a plurality of frequencies, the element part conductor and the coupling conductor on one hypothetical plane may be composed of a conductor plate and a portion of the coupling conductor may be composed by forming a cut portion in the conductor plate. Such structure is easy in manufacturing and contributes to reduction in cost.

Further, the present invention may provide a wide band antenna common to a plurality of frequencies having a planar dipole antenna structure, including: two wide band planar monopole antennas common to a plurality of frequencies; and feeders provided to each of the wide band planar monopole antenna common to a plurality of frequencies.

EXPLANATION OF REFERENCE NUMERALS

10: large planar conductor, 20: small planar conductor, 30: coupling conductor, 41: feeder

BEST MODE FOR CARRYING OUT THE INVENTION

An embodiment of the present invention will be explained with reference to the drawings.

It is noted that various changes may be made in design of structure of the present invention without departing from the scope of the invention and conventional art such as the above documents may be applied to details in the structure of the present invention.

In general, since an antenna should be designed to include a band or resonance characteristics in accordance with the purpose of use to be the most preferred embodiment, it should be understood that the following embodiments are not universally the most preferred embodiment.

Figure 1:
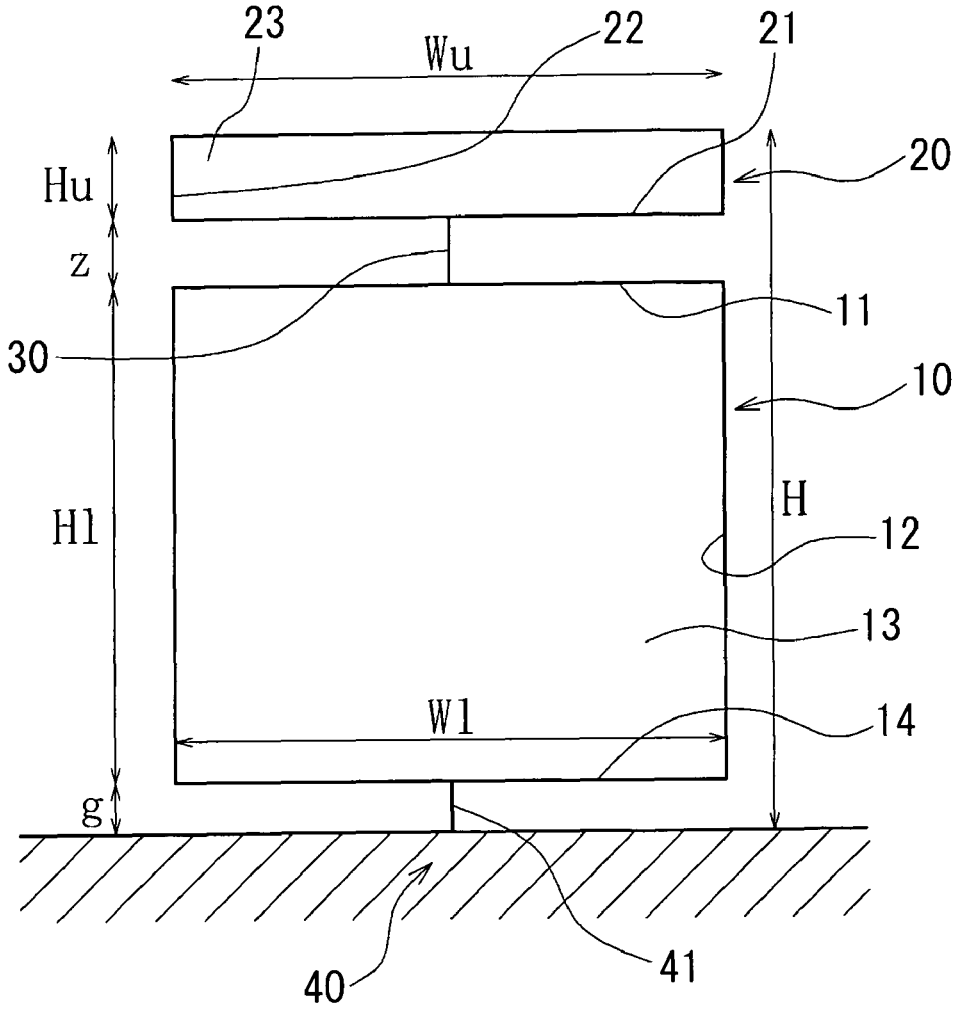
FIG. 1 is a front view of a wide band planar monopole antenna common to a plurality of frequencies according to the present invention.

FIG. 1 is a front view of a wide band planar monopole antenna common to a plurality of frequencies according to the present invention.

Figure 3:
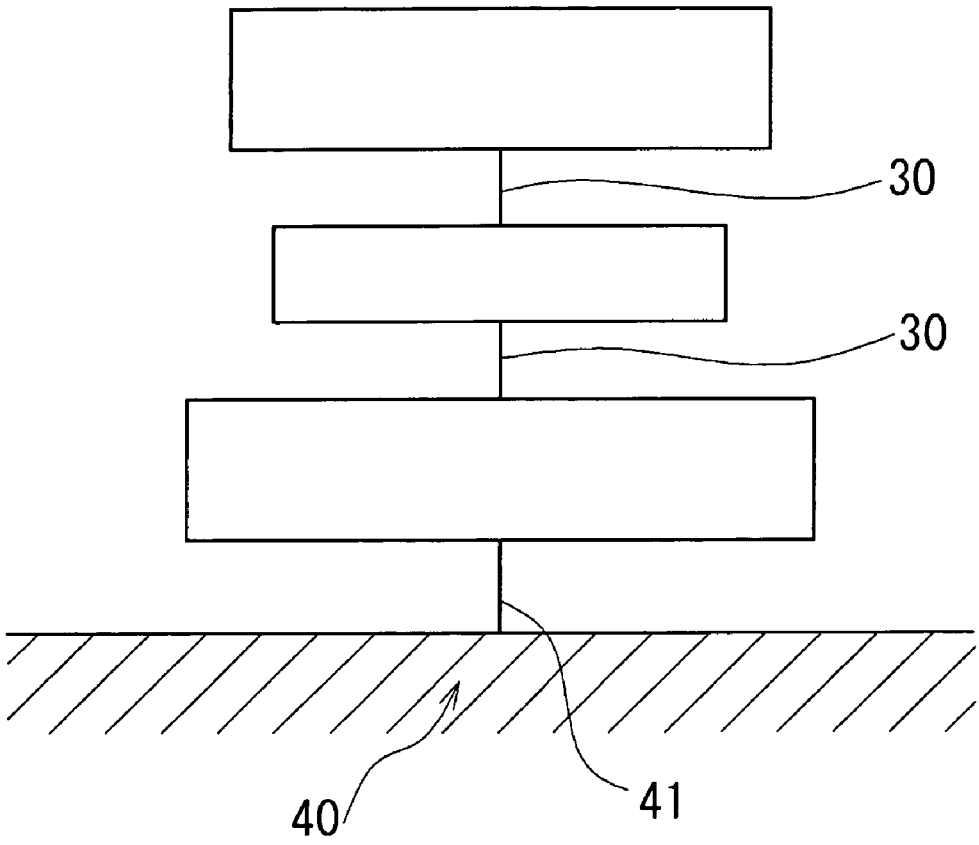
FIG. 3 is a front view of another embodiment of the wide band planar monopole antenna common to a plurality of frequencies according to the present invention.

Here, the wide band planar monopole antenna common to a plurality of frequencies provided on an infinite bottom plate is shown. In the example shown in FIG. 1, planar conductors are used as element part conductors and two planar conductors are provided. However, the number of the planner conductors should not be limited to be two. For example, as shown in FIG. 3, when its purpose is focused on three resonance frequencies, three planar conductors may be provided. Similarly, in order to obtain an antenna characteristic in accordance with a desired purpose, four or more planar conductors may be provided.

In general, it is preferable to provide planar conductors as many as the desired number of resonance frequencies, and the number of resonance frequencies may be arbitrarily determined according to the number of planar conductors.

The respective planar conductors are arranged on a hypothetical plane and constitute a planar monopole antenna as a whole.

As the size or shape of the planar conductor is changed, particularly height or/and width is changed when the planar conductor is a squared shape, the resonance frequency and a band can be changed and an antenna can be arbitrarily designed in accordance with a desired purpose. Concretely, in case that the planar conductor is a squared shape, the number of resonance frequency is changed by changing its length in heightwise direction and the region of band is changed by changing its length in crosswise direction. Here, it is noted that they can be changed also by the number of planar conductors or arrangements of the planar conductors.

Therefore, the plurality of planar conductors may be provided in different shapes or different sizes in general. However, the planar conductors are not required to be different in their shapes or sizes and the planar conductors having almost same shapes or sizes may be provided.

In such case, a plurality of frequencies can be shared while wide band characteristics are maintained. According to the wide band planar monopole antenna common to a plurality of frequencies of the present invention, it is no exaggeration to say that the planar conductors provided to the monopole antenna satisfy both of wide band characteristics and sharing of frequencies.

The plurality of planar conductors is coupled sequentially such that they are strung together like beads. The respective planar conductors are electrically coupled by coupling conductors. A part of the planar conductor where the coupling conductor is coupled is not a plane part but an edge part of the planar conductor. In general, it is not preferable to couple the coupling conductor to a plane part of the planar conductor, since it may have an effect on the antenna characteristics (such as a radiation characteristic) and a desired wide band characteristic is not obtained, for example.

One planar conductor located at an extremity among the plurality of planar conductors which are sequentially coupled has a feeder for electrically coupling the planar conductor and a feeder part in order to be fed from the feeder part adapted to feed the planar conductors. In general, one planar conductor at an extremity is fed in order not to affect current distributions generated in each planar conductor of monopole antenna, particularly, in the planar monopole antenna of the present invention. However, feeding to a plurality of planar conductors should not be excluded.

As shown in the drawing, according to the present embodiment, one end of the feeder part is connected to the ground.

According to the planar monopole antenna of the present invention, in order to make the planar conductor to include a nondirectional antenna characteristic on a plane in a direction almost vertical to the planar conductor, the respective planar conductors are preferably coupled linearly in addition to coupling them sequentially as described above. Further, the feeder part and the respective planar conductors are preferably coupled linearly. Thereby, a planar nondirectional characteristic can be maintained to some degree; however, the following structure is more preferable to obtain better planar nondirectional characteristics.

Specifically, since the respective planar conductors are coupled sequentially as described above, the planar conductors other than the planar conductor located at an extremity have two coupling parts. Here, the shape of each planar conductor is formed symmetrically with respect to a line connecting the two coupling parts which are coupled with coupling conductors.

A lower planar conductor to which a feeder is connected is formed symmetrically with respect to a line connecting a coupling part connected to the feeder and the coupling part connected to the coupling conductor. The planar conductor located at an extremity has one coupling part and formed in a symmetrical shape similar to other planar conductors. This forming of the planar conductors may enable current distribution generated between the coupling parts in the planar conductors to be symmetrical with respect to the line connecting the coupling parts.

The coupling conductors for coupling each planar conductor are arranged linearly substantially. Here, "arranged linearly" is conceptually understood as drawing a dashed line on a hypothetical straight line. With such arrangement, it is conceptually considered as if current flows linearly, and current distributions generated on each planar conductor may become symmetrical with respect to the hypothetical straight line on which the coupling conductors are arranged. The above described shape and arrangement allow a better planar nondirectional antenna characteristic.

The planner conductor may be composed of a plurality of planar conductors combined by the coupling part as a central axis. For example, with the coupling part as a central axis, two planar conductors may be combined at an angle of 90 degrees. Then, a plurality of such combined planar conductors may be coupled sequentially as described above. (See FIG. 7)

Figure 7:
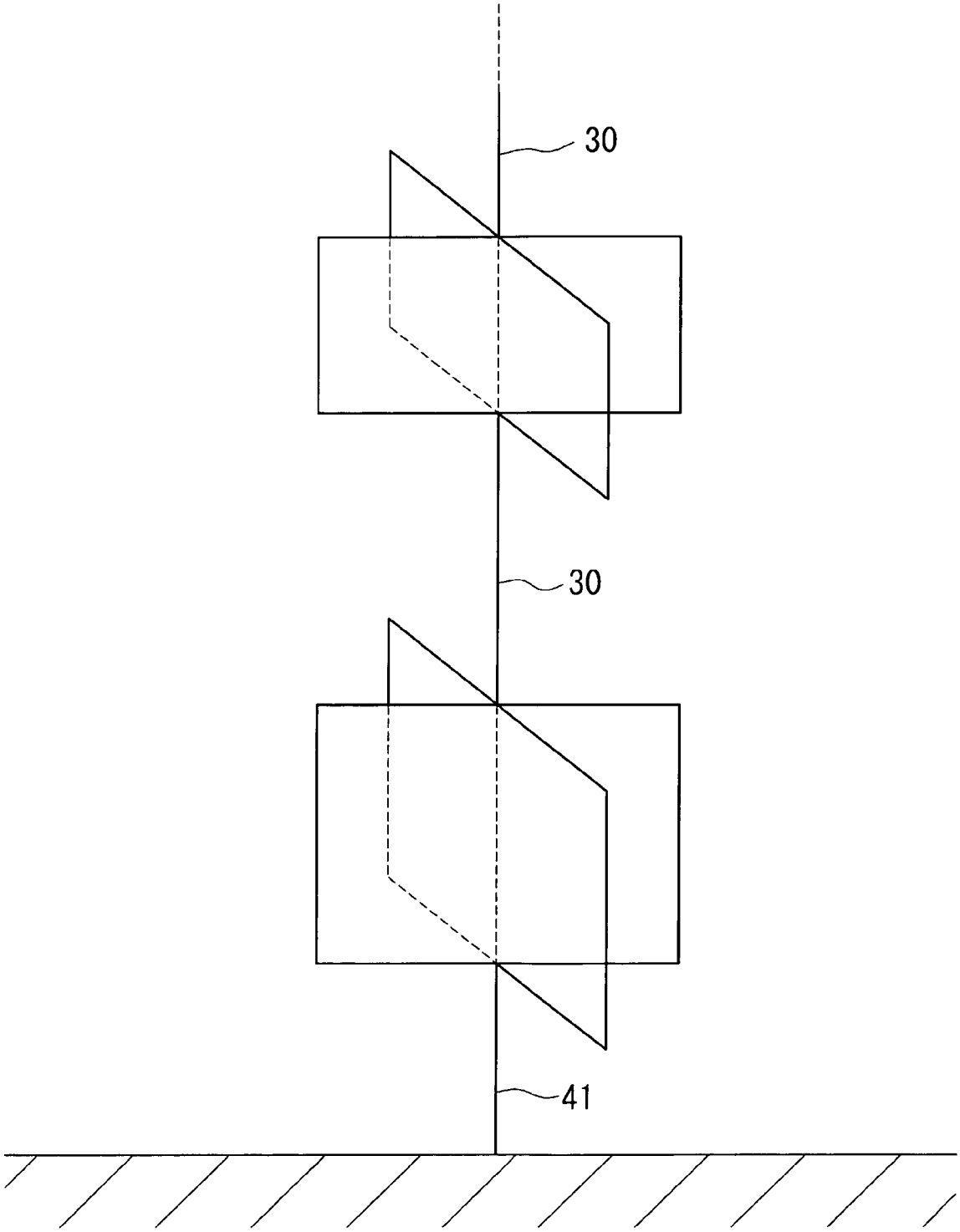
FIG. 7 is a view showing an embodiment of the wide band planar monopole antenna common to a plurality of frequencies according to the present invention.

In FIG. 7, an earthed feeder (41) is provided at the lowest extremity and a plurality of planar conductors are coupled by coupling conductors (30). The feeder (41) and the coupling conductors (30) function as an axis.

According to this structure, in the above planar monopole antenna, planar conductors provided on a hypothetical plane are orthogonal to provide an orthogonal planar monopole antenna structure.

Figure 8:
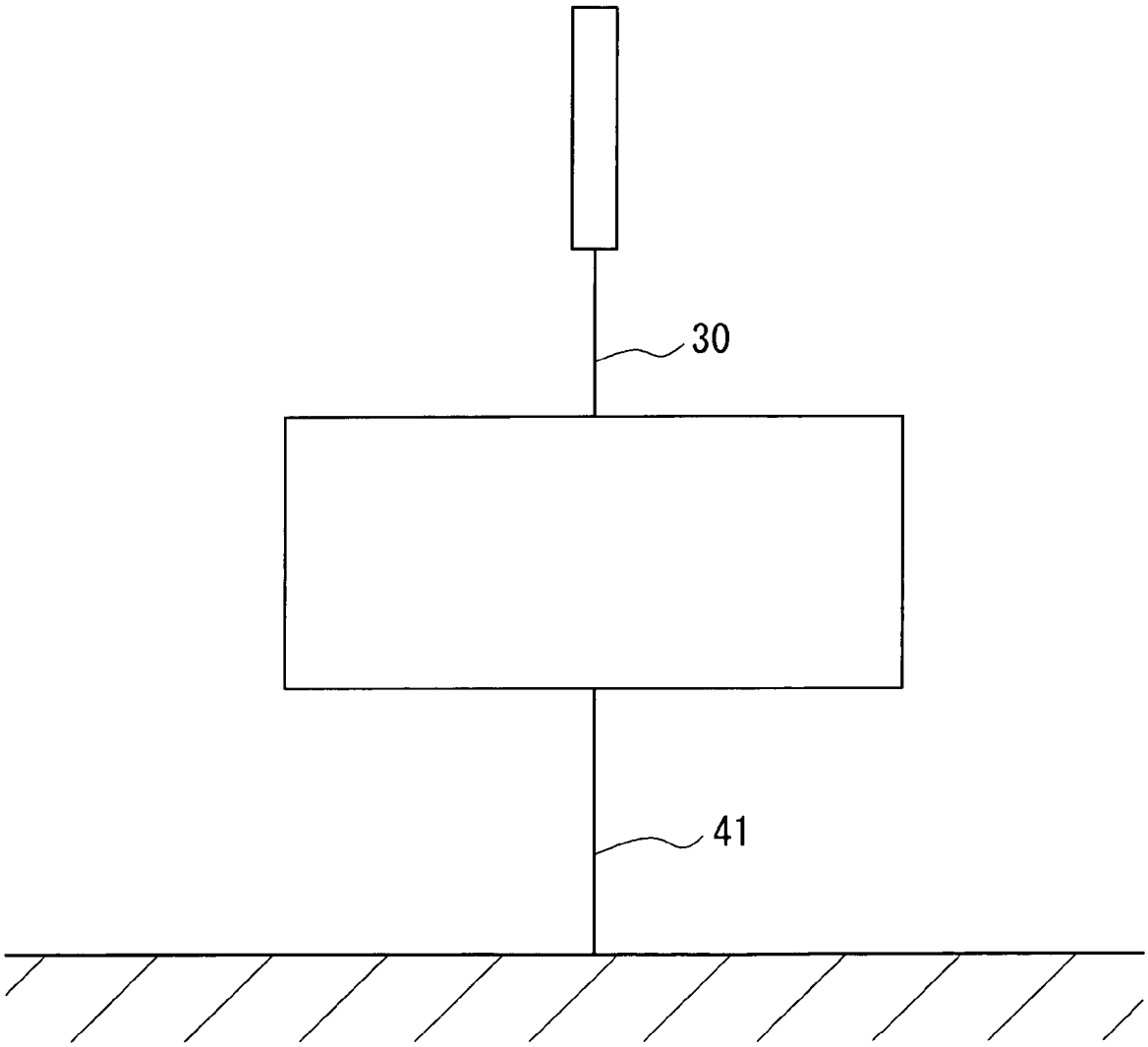
FIG. 8 is a view showing another embodiment of the wide band planar monopole antenna common to a plurality of frequencies according to the present invention.

Further, the plane parts of each planar conductor are preferably arranged to be substantially parallel; however, the planar conductors may be arranged so that the facing directions of the plane parts of each planar conductor differ at an angle of 90 degrees, for example. (See FIG. 8)

Further, when the planar conductors are arranged so that the plane parts of each planar conductor are substantially vertical, a nondirectional antenna characteristic can be obtained on a substantially horizontal plane.

The shape of the planar conductor may be formed in a square shape, such as a regular tetragon or a rectangular. Such shapes of the planar conductor allow an easier antenna manufacturing, and since the coupling parts are provided in the middle of the edge parts, it is formed to be a symmetrical shape as described above. It is noted that the shape of the planar conductors are not limited to squared shapes and it may be formed in an oval figure. (See FIG. 4)

Figure 9:
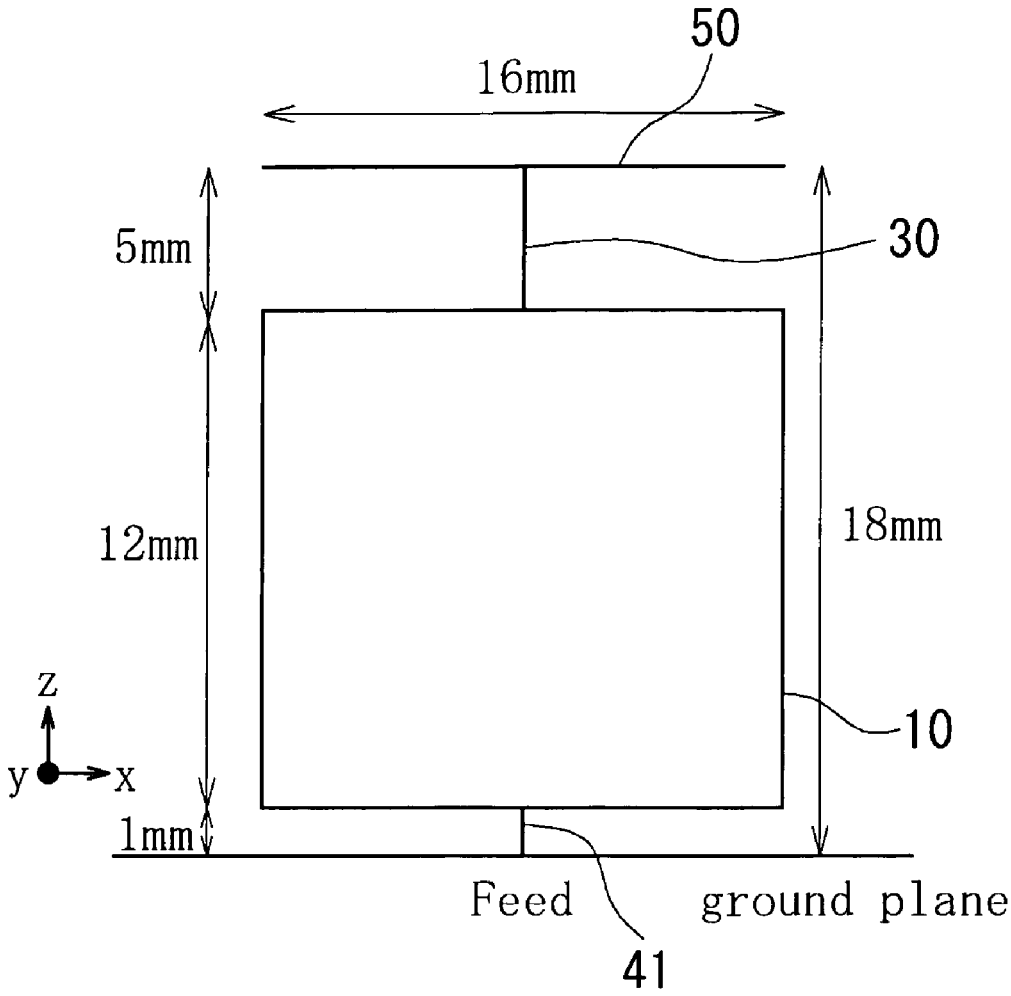
FIG. 9 is a front view of a wide band planar monopole antenna common to a plurality of frequencies having an upper element part conductor in a linear shape according to the present invention.
Figure 10:
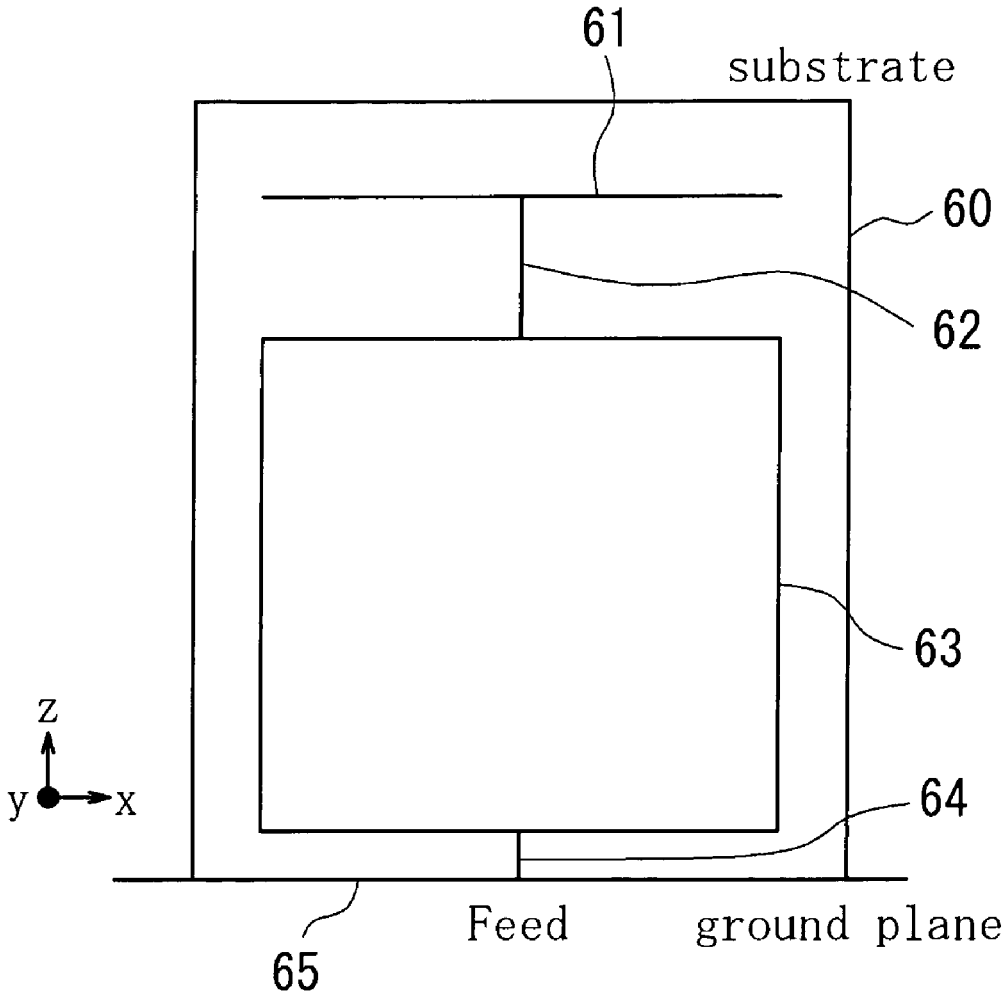
FIG. 10 is a front view of an antenna provided on a substrate according to the present invention.
Figure 11:
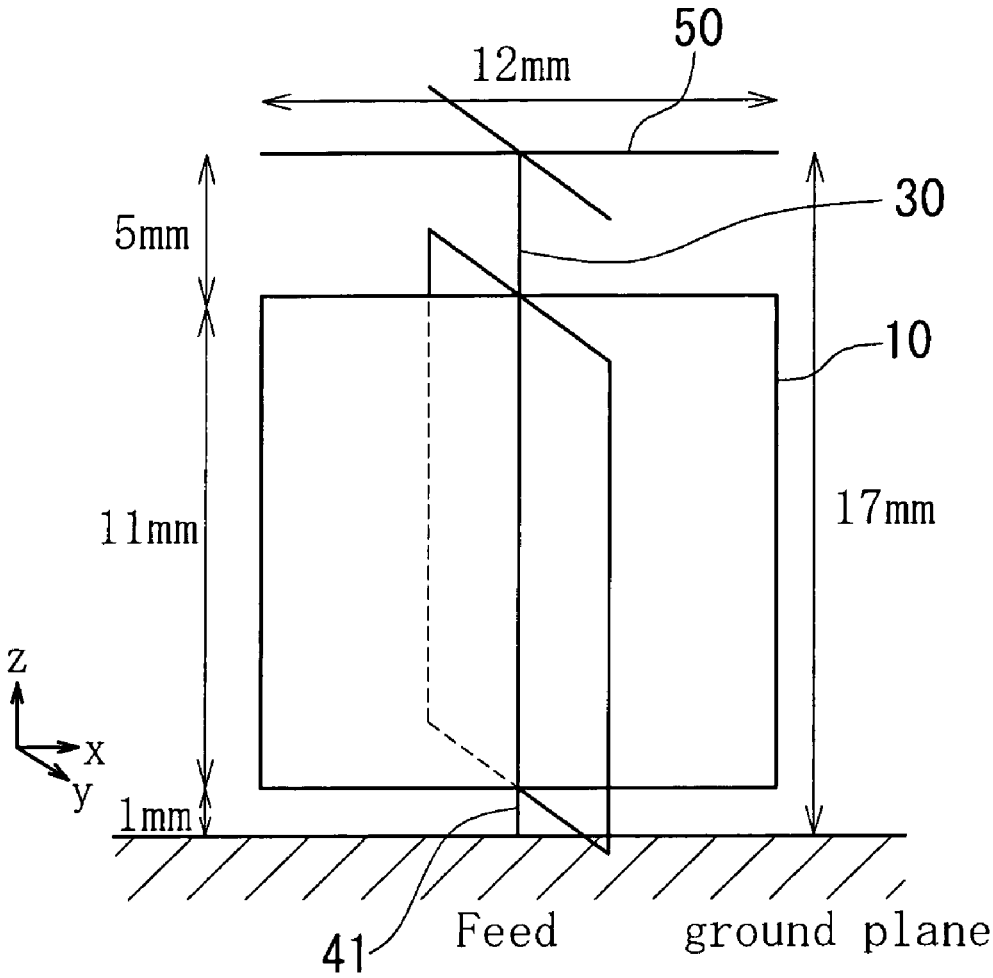
FIG. 11 is a perspective view showing a wide band planar monopole antenna common to a plurality of frequencies including orthogonal monopole antennas.

Further, according to the present invention, an element part conductor may be composed of a linear shape with a wire or the like in addition to a planar shape. For example, FIGS. 9 to 11 show examples in which an upper conductor is formed in a linear shape. In FIGS. 9 and 11, sizes of antennas for sharing a plurality of frequencies in an ultrawideband are shown.

In FIG. 9, an upper element part conductor (50) is a wire and coupled with a lower planar conductor (10) by a coupling conductor (30). The linear conductor (50) is provided so as to be parallel to the planar conductor (10) and be on a hypothetical plane.

FIG. 10 shows an embodiment in which the planar monopole antenna of the present invention is provided on a substrate (60). For example, conductor on the resin substrate is etched to form a linear conductor (61), a coupling conductor (62), a lower planar conductor (63), and a feeder (64). The feeder (64) is also connected to a ground plane (65).

Its fundamental principle is same as that of the above structure, but an antenna can be made easily in this structure and it contributes to downsizing, greater decay resistance, and lower cost in manufacturing.

FIG. 11 is another embodiment of the orthogonal planar monopole antenna shown in FIG. 7 and the upper conductor (50) is formed in a linear shape. The horizontal nondirectional characteristic is also improved in this structure.

Figure 12:
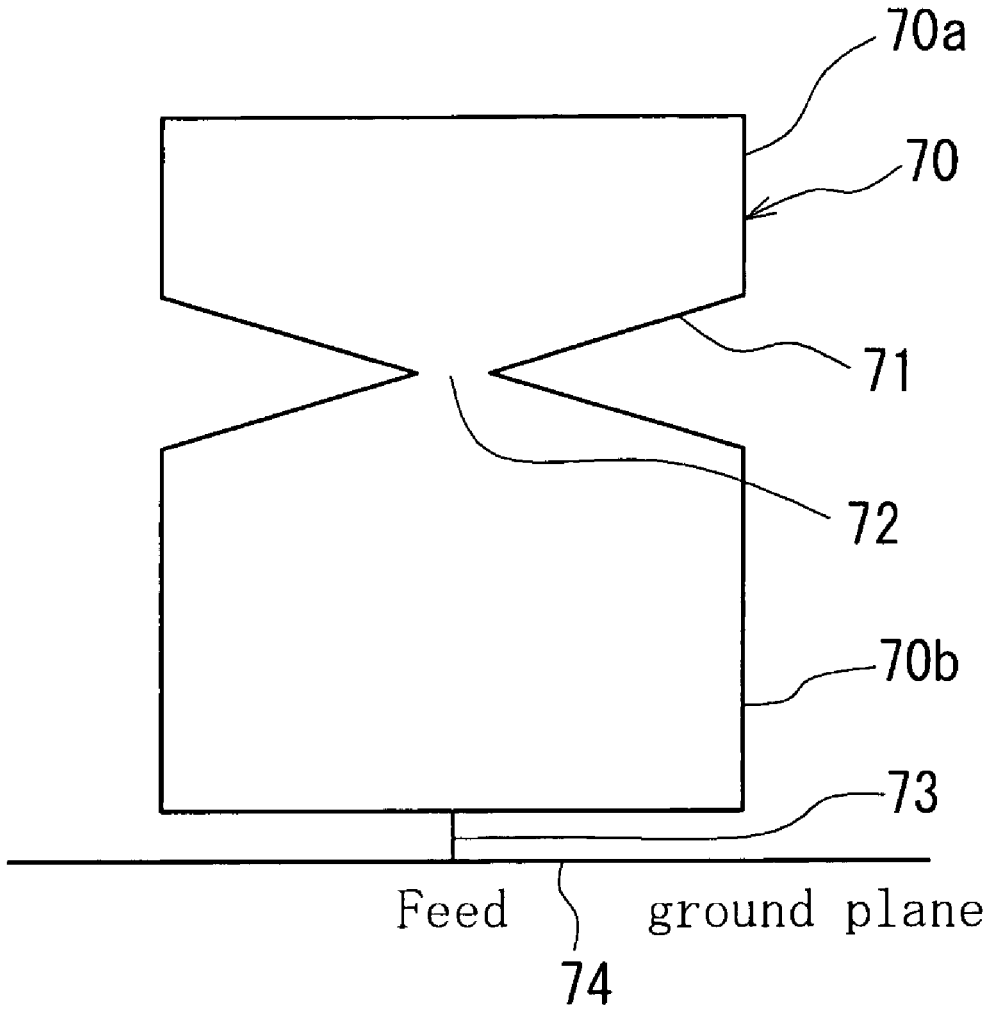
FIG. 12 is a view showing an embodiment of a monopole antenna composed of a single conductor plate according to the present invention.

FIG. 12 shows a modification of the above planar monopole antenna. Here, the coupling conductor is not provided as an independent conductor and the upper conductor, the coupling conductor, and the lower conductor are composed of one conductor plate (70). A cut portion (71), for example in a triangular shape, is provided to the conductor plate (70) to form a coupling part (72) and to separate an upper conductor (70*a*) and a lower conductor (70*b*). A feeder (73) feeds the conductor plate and the feeder (73) is connected to the ground plane (74). The shape of the cut portion can be determined arbitrarily.

With this structure, a planar monopole antenna having effects similar to the above described effects can be provided.

Figure 13:
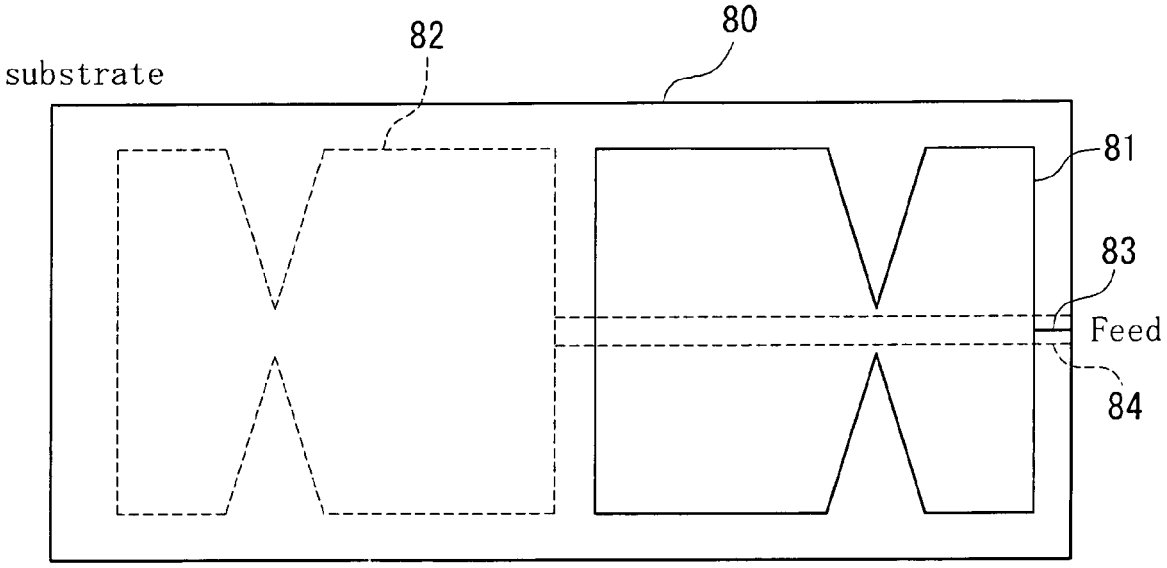
FIG. 13 is a front view of a wide band planar dipole antenna common to a plurality of frequencies composed of two monopole antennas.

Further, FIG. 13 is a front view of a wide band antenna common to a plurality of frequencies of the present invention with a planar dipole antenna structure. As is well known, a planar dipole antenna is not connected to a grand plane and composed of two monopole antennas which are fed separately.

In the drawing, conductor antenna patterns (81), (82) are provided on both sides of a substrate (80) so that the antenna pattern (82) in a symmetric shape is formed with respect to the antenna pattern (81) as a symmetrical axis. The patterns are made by providing the structure of FIG. 12 on the substrate and feeders (83), (84) are provided to each of the patterns to feed them.

With such structure, a wide band antenna for suppressing interference can be realized.

Here, the structure of the dipole antenna is not limited to the above and antenna patterns may be arranged symmetrically on one surface of the substrate and feeders may be provided arbitrarily such as providing downwardly between the antenna patterns.

According to the implementation of the present invention, an interval between the element part conductors may be provided to be variable. Because the interval of the element part conductors are variable, antenna characteristics can be adjusted. The detail will be described later.

The wide band planar monopole antenna common to a plurality of frequencies, shown in FIG. 1, which is an embodiment of the present invention, will be explained in detail.

In FIG. 1, one planar conductor is a large planar conductor (10) in a regular tetragon and the other planar conductor is a small planar conductor (20) having a long side (21) that is almost same length as one of the sides (11), (12) of the large planar conductor and a shorter side (22) that is shorter than the longer side. This is, for example, composed of a planar monopole antenna in a substantially squared shape with height H [mm] and width W [mm] having a slit with width z [mm] or by providing two planar conductors in a substantially squared shape, which are coupled by a coupling conductor with length z [mm].

Here, the facing sides (11), (21) of the large planar conductor (10) and the small planar conductor (20) are almost equal in view of an inspection of the embodiment, which will be described later. However, as described above, they may be formed with different lengths in order to obtain preferred antenna characteristics (See FIGS. 2 and 3). It is also noted that the large planar conductor is not required to be a regular tetragon, but may be a rectangular.

The large planar conductor (10) and the small planar conductor (20) are arranged such that the longer side (21) of the small planar conductor (20) and one of the sides (11), (12) of the large planar conductor (10) are arranged parallelly and separately and surfaces (13) and (23) of the large planar conductor (10), and the small planar conductor (20) are arranged parallelly and vertically, and the large planar conductor (10) is provided under the small planar conductor (20). More preferably, the small planar conductor (20) is provided on the side of the large planar conductor (10) opposite to the side connected to a later described feeder (41). Further, this applied to the case that three or more planar conductors are provided. Here, the large planar conductor (10) may be provided above the small planar conductor (20).

Between the longer side (21) of the small planar conductor (20) and one side (11) of the large planar conductor (10) facing the longer side (21) of the small planar conductor (20), a coupling conductor (30) is provided to electrically couple the large planar conductor (10) and the small planar conductor (20). A coupling part to which the coupling conductor (30) is coupled is located in the almost middle of each side (11), (21).

The coupling conductor (30) may be a pole having strength to support the small planar conductor (20) or a flexible line provided with a firm pipe. Further, a supporting member (not shown) for supporting the small planar conductor (20) may be provided separately from the coupling conductor (30).

An example of a mechanism for adjusting the interval between the large planar conductor (10) and the small planar conductor (20) will be explained.

In order to realize a retractility structure, the firm pipe may be formed in a retractility structure. For example, an inner pipe having a diameter smaller than a hollow portion of an outer pipe is inserted into the hollow portion of the outer pipe and extracting and inserting the inner pipe realizes a retractility structure. The coupling conductor is a flexible wire, which bends or expands in accordance with expansion/contraction of the pipe. That is, the coupling conductor bends when the pipe is shortened and the coupling conductor extends as if the bending is pulled when the pipe is elongated.

With such mechanism, the interval between the planar conductors can be adjusted.

According to such embodiment, when the amount of the bending is large, the bent coupling conductor may overlap the plane part of the planar conductor and it may have an effect on its antenna characteristics. Accordingly, another embodiment will be explained to solve this problem.

That is, the above described outer pipe and inner pipe are made of material such that they electrically communicate with each other. Then, the outer pipe and the inner pipe can electrically communicate with each other when they are contacted each other in the outer pipe. This arrangement prevents bending of the coupling conductor.

A feeder part (40) adapted to feed the monopole antenna and one side of the large planar conductor (10) on the side facing a side (11) to be coupled with the coupling conductor (30), that is a feeding side (14), are electrically coupled by the feeder (41). The coupling part to which the feeder (41) is coupled is located in almost middle of the feeding side (14) of the large planar conductor (10).

Figure 2:
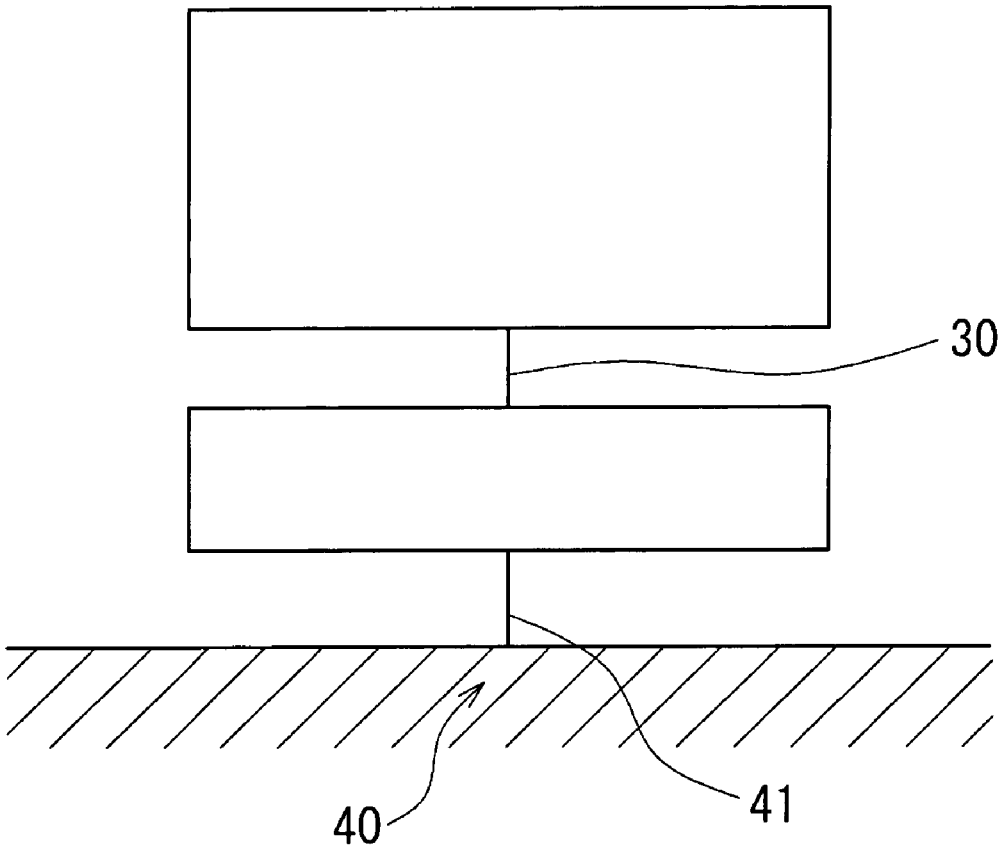
FIG. 2 is a front view of another embodiment of the wide band planar monopole antenna common to a plurality of frequencies according to the present invention.
Figure 4:
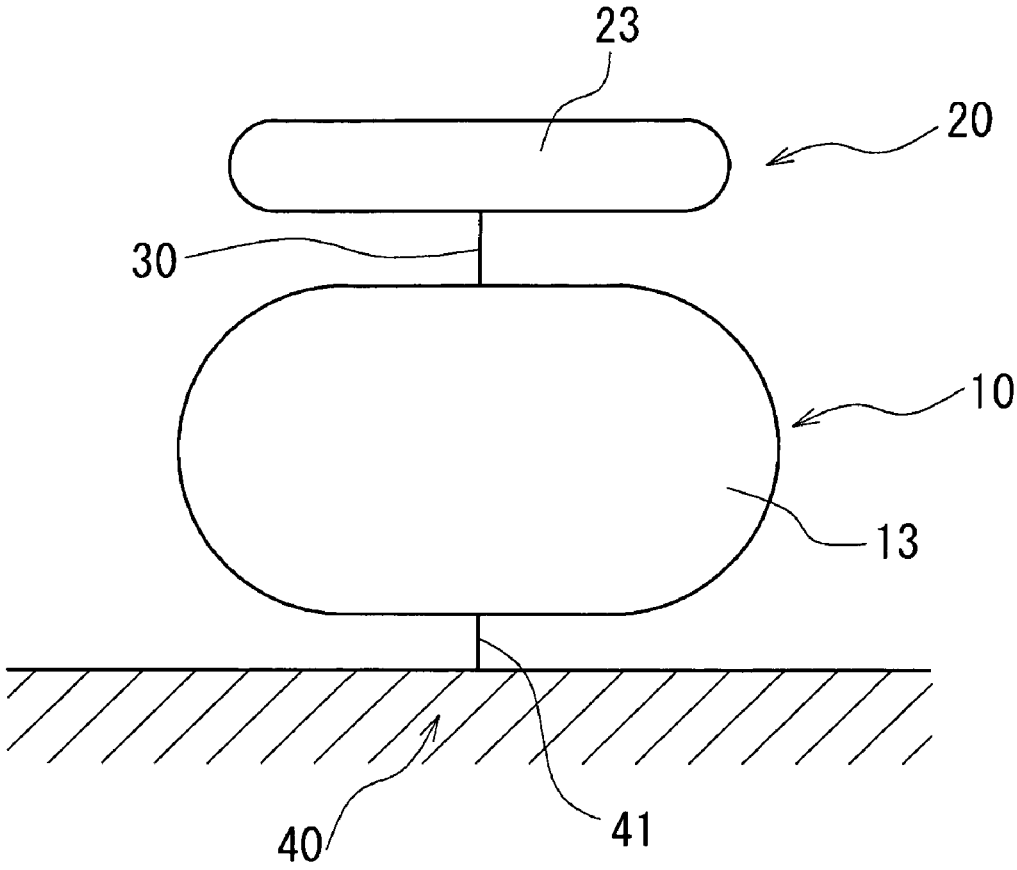
FIG. 4 is a front view of another embodiment of the wide band planar monopole antenna common to a plurality of frequencies according to the present invention.

As embodiments other than the wide band planar monopole antenna common to a plurality of frequencies shown in FIG. 1, FIGS. 2 to 4 and 7 to 13 will be explained. FIG. 2 shows a case in which the large planar conductor (10) is provided above the small planar conductor 20. FIG. 3 shows a case in which three planar conductors are provided and sizes and shapes of those planar conductors are different. FIG. 4 shows a case in which the two planar conductors are in substantially oval figures. Here, when a plurality of planar conductors are provided, an oval planar conductor and a squared planar conductor may be employed in combination.

As it is understood with the embodiments shown in the drawings, the coupling conductors (30) are arranged substantially linearly. In this example, the feeders (41) are arranged on a straight line on which the coupling conductors (30) are arranged. When this straight line is seen as a hypothetical straight line, the entire antenna is almost symmetric with respect to the hypothetical straight line. Therefore, secure horizontal nondirectional characteristics can be realized.

<Inspection>

The embodiment shown in FIG. 1 was inspected with the following specific sizes: the length of the feeder (41) of the feeder part (40) g=1 [mm], the small planar conductor (20) is Hu×Wu [mm], the large planar conductor (10) is Hl×Wl [mm], H=20, W=12 [mm], and the interval between the small planar conductor (20) and the large planar conductor (10), that is, length of the coupling conductor (30) z=4 [mm].

Assuming Hu=2, Hl=13, and Wu=Wl=12 [mm], the resonance characteristic is analyzed using an FDTD method.

Figure 5:
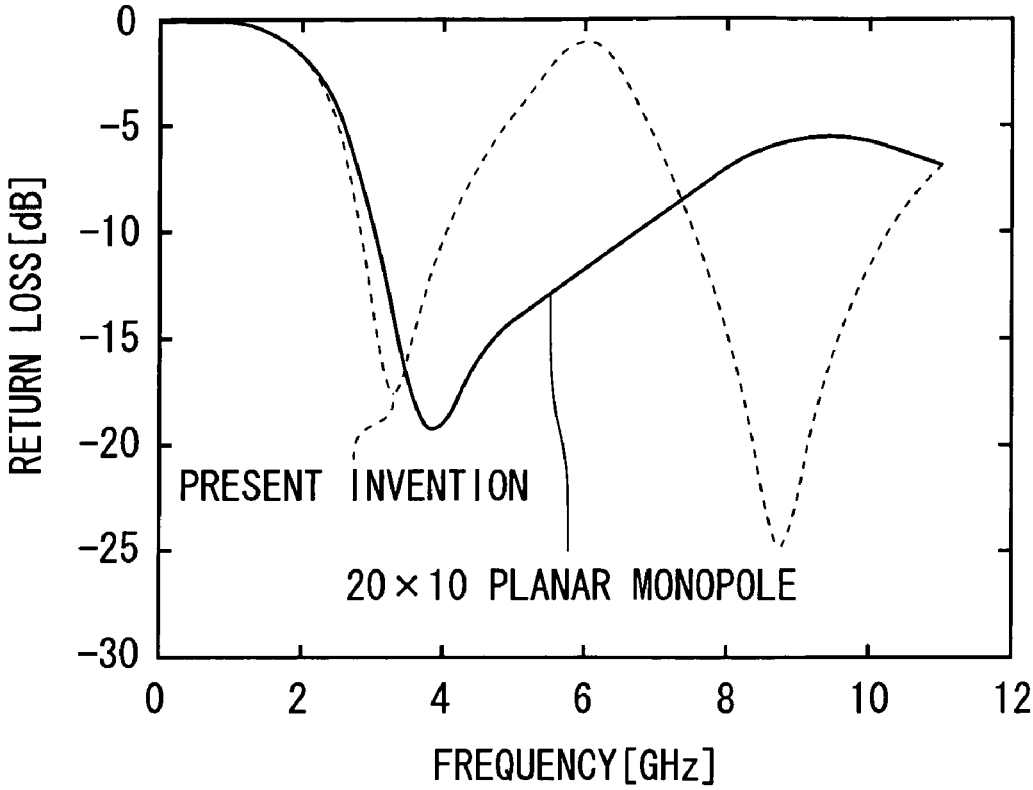
FIG. 5 is a graph showing resonance characteristics.

The analysis result is shown in FIG. 5. It covers most of the frequency band in the UWB system while resonance of a particular frequency band is controlled. Here, it is compared with a planar monopole antenna which is a monopole antenna adapted to wide band.

Accordingly, it is confirmed that a monopole antenna shows characteristics common to two frequencies with the structure of the embodiment as an example according to the present invention. Further, although the inspection result is not shown here, the inventors have confirmed that the antenna has three resonance frequencies when three planar conductors are provided.

Figure 6:
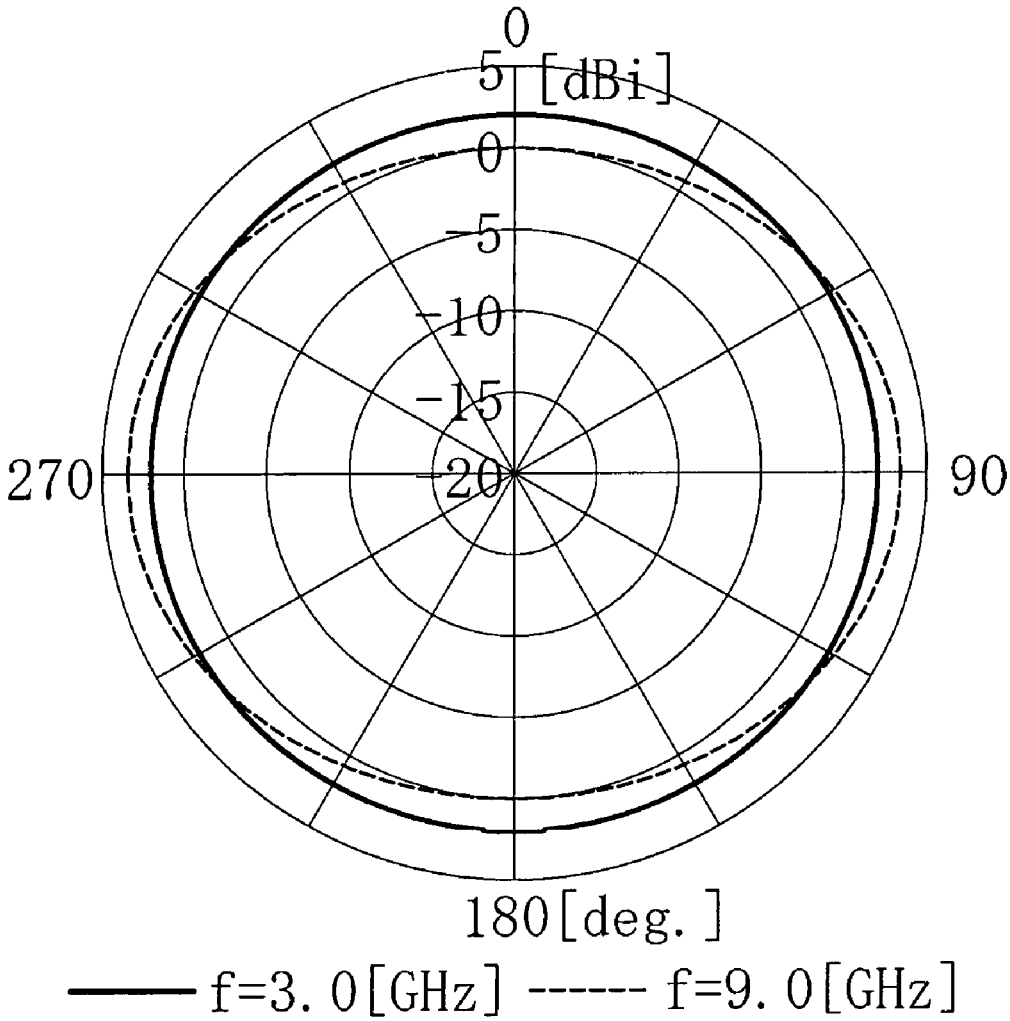
FIG. 6 is a graph showing radiation characteristics.

The UWB system is employed in an ultrawideband in a range of 3.1 to 10.6 [GHz]. Here, analysis results of radiation characteristics on a horizontal surface of 3.0 and 9.0 [GHz] are shown in FIG. 6.

Therefore, it has been confirmed that antenna characteristics close to nondirectional characteristics are obtained in each frequencies.

INDUSTRIAL APPLICABILITY

Since the antenna according to the present invention is an antenna, with a simple structure, which covers wide band, is common to a plurality of frequencies, and suppresses interference with other systems, it can be employed to the UWB system or the like at a low cost and has a great deal of potential in industry.

The invention claimed is:

1. A wide band antenna compatible with a plurality of frequencies including an orthogonal planar monopole antenna structure which has wide band characteristic to cover desired frequencies and suppress interfering frequency band, comprising:

a plurality of orthogonal conductors, each of the orthogonal conductors including either two wire conductors intersecting and orthogonal to each other, or two plate conductors intersecting and orthogonal to each other and arranged vertically to a horizontal plane;

a coupling conductor configured to electrically couple two immediately adjacent orthogonal conductors; and a feeder configured to electrically couple one of the orthogonal conductors with a feeder part capable of feeding the one of the orthogonal conductor, wherein the orthogonal conductors are concatenated sequentially by the coupling conductor, and wherein the coupling conductor is arranged substantially linearly along a central axis of the two immediately adjacent orthogonal conductors.

2. The wide band planar monopole antenna according to claim 1, wherein an interval between two immediately adjacent orthogonal conductors is adjustable.

3. The wide band antenna according to claim 1, wherein the central axes of the orthogonal conductors are aligned with each other.

4. A wide band antenna compatible with a plurality of frequencies including an orthogonal planar monopole antenna structure which has wide band characteristic to cover desired frequencies and suppress interfering frequency band, comprising:

a plurality of orthogonal conductors, each of the orthogonal conductors including either two wire conductors intersecting and orthogonal to each other, or two plate conductors intersecting and orthogonal to each other and arranged vertically to a horizontal plane;

a coupling conductor configured to electrically couple two immediately adjacent orthogonal conductors; and a feeder configured to electrically couple one of the orthogonal conductors with a feeder part capable of feeding the one of the orthogonal conductor, wherein the orthogonal conductors are concatenated sequentially by the coupling conductor, and wherein one of the orthogonal conductors includes the two wire conductors, and another one of the orthogonal conductors includes the two plate conductors.

5. The wide band antenna according to claim 4, wherein one of the wire conductors is coplanar with one of the plate conductors on a first hypothetical plane, and the other one of the wire conductors is coplanar with the other one of the plate conductors on a second hypothetical plane.

6. A wide band antenna compatible with a plurality of frequencies including an orthogonal planar monopole antenna structure which has wide band characteristic to cover desired frequencies and suppress interfering frequency band, comprising:

a plurality of orthogonal conductors, each of the orthogonal conductors including either two wire conductors intersecting and orthogonal to each other, or two plate conductors intersecting and orthogonal to each other and arranged vertically to a horizontal plane;

a coupling conductor configured to electrically couple two immediately adjacent orthogonal conductors; and a feeder configured to electrically couple one of the orthogonal conductors with a feeder part capable of feeding the one of the orthogonal conductor, wherein the orthogonal conductors are concatenated sequentially by the coupling conductor, and wherein each of the orthogonal conductors includes two plate conductors intersecting and orthogonal to each other and arranged vertically to the horizontal plane.

7. The wide band antenna according to claim 6, wherein one of the plate conductors of each of the orthogonal conductors is coplanar with each other on a first hypothetical plane, and the other one of the plate conductors of each of the orthogonal conductors is coplanar with each other on a second hypothetical plane.

* * * * *